US009888815B2

(12) United States Patent
Borchard

(10) Patent No.: US 9,888,815 B2
(45) Date of Patent: Feb. 13, 2018

(54) HAND SANITIZER LATCH CONTROL

(71) Applicant: James Borchard, Camarillo, CA (US)

(72) Inventor: James Borchard, Camarillo, CA (US)

( * ) Notice: Subject to any disclaimer, the term of this patent is extended or adjusted under 35 U.S.C. 154(b) by 42 days.

(21) Appl. No.: 14/856,098

(22) Filed: Sep. 16, 2015

(65) Prior Publication Data

US 2017/0071418 A1 Mar. 16, 2017

(51) Int. Cl.

| | |
|---|---|
| ***A47K 5/12*** | (2006.01) |
| ***G07C 9/00*** | (2006.01) |
| *B05B 15/06* | (2006.01) |

(52) U.S. Cl.

CPC ..... *A47K 5/12* (2013.01); *G07C 9/00896* (2013.01); *A47K 5/1207* (2013.01); *A47K 5/1211* (2013.01); *A47K 5/1217* (2013.01); *B05B 15/06* (2013.01)

(58) Field of Classification Search

CPC ... B67D 1/07; B67D 7/06; A47K 5/12; A47K 5/1207; A47K 5/1217; A47K 5/13; A47K 5/14; A47K 5/16; A47K 5/1202; A47K 5/1204; A47K 5/1211; B05B 11/0037; B05B 15/06; G04C 23/36; G04C 23/42; G04C 23/48; G04C 23/50; G07C 9/00896; A61L 2/00

USPC ..... 222/181.3, 192, 638–649, 52, 63, 391, 222/504–509; 422/28, 107; 239/282–283, 451–460

See application file for complete search history.

(56) References Cited

U.S. PATENT DOCUMENTS

| | | | | |
|---|---|---|---|---|
| 5,808,553 | A * | 9/1998 | Cunningham | G08B 21/245 340/528 |
| 7,320,418 | B2 * | 1/2008 | Sassoon | A61L 2/18 222/1 |
| 8,061,562 | B2 * | 11/2011 | Carpenter | A61L 9/14 222/504 |
| 8,152,027 | B1 * | 4/2012 | Baker | A61L 2/18 222/1 |
| 8,215,523 | B2 * | 7/2012 | Ophardt | A47K 5/1207 222/181.3 |
| 8,408,423 | B1 * | 4/2013 | McKnight | A61L 2/14 222/180 |
| 9,255,423 | B2 * | 2/2016 | Oshmyansky | A61L 2/18 |
| 2004/0026530 | A1 * | 2/2004 | Callueng | A61L 2/22 239/69 |
| 2009/0265990 | A1 * | 10/2009 | Stratmann | A47K 5/12 49/31 |
| 2009/0308887 | A1 * | 12/2009 | Woo | A47K 5/1215 222/52 |
| 2009/0324444 | A1 * | 12/2009 | Stratmann | G08B 21/245 422/28 |
| 2011/0047876 | A1 * | 3/2011 | Houser | A47K 5/06 49/70 |

(Continued)

*Primary Examiner* — Paul R Durand
*Assistant Examiner* — Andrew P Bainbridge
(74) *Attorney, Agent, or Firm* — Donald R. Boys; Central Coast Patent Agency, LLC

(57) ABSTRACT

A system having a dispenser enabled to contain and dispense a liquid or semi-liquid material and located on a wall of a facility having a door, a user-operable triggering mechanism causing dispensing of a volume from the dispenser upon operation of the triggering mechanism, and a door latch mechanism incorporated at an opening edge of the door of the facility and coupled to the dispenser in a manner that operating the triggering mechanism to dispense the volume also unlatches the door latch mechanism, allowing the door to open.

13 Claims, 4 Drawing Sheets

(56) References Cited

U.S. PATENT DOCUMENTS

| | | | | |
|---|---|---|---|---|
| 2011/0147416 | A1* | 6/2011 | Nauels | A47K 5/1208 222/181.3 |
| 2012/0080451 | A1* | 4/2012 | Williams | A61L 2/22 222/181.3 |
| 2013/0043284 | A1* | 2/2013 | Wegelin | A47K 5/12 222/402.13 |
| 2014/0346194 | A1* | 11/2014 | Oshmyansky | A61L 2/18 222/192 |

* cited by examiner

HAND SANITIZER LATCH CONTROL

BACKGROUND OF THE INVENTION

1. Field of the Invention

The present invention is in the technical field of sanitary operations, and pertains more particularly to apparatus and methods for ensuring that workers use hand sanitization after using a toilet, particularly in food packaging and preparation operations, handling of produce, and in any operations involving food stuffs.

2. Description of Related Art

It is well-known that washing ones hands or at least applying a sanitization material to the hands after using toilet facilities is highly desirable to maintain sanitary conditions in many commercial operations. In fact, most restrooms in businesses of all sorts have signs that refer to rules, laws and ordinances on the subject.

One particular situation where this issue may be a problem is in commercial operations where workers a picking and handling produce, such as berries and vegetables, and portable toilet facilities are provided for the worker's use.

In most operations portable toilets provided have limited or no water supply. These portable units sometimes offer hand sanitizer or disinfectant to kill or neutralize germs and bacteria from one user to the next. But it is left up to an individual's discretion whether to wash or sanitize their hands, even though it is typically a requirement for anyone working around foodstuffs for human consumption. Therefore what is clearly needed is an apparatus and method that will significantly increase the probability that an individual, after using toilet facilities, will use at least a hand sanitizer before returning to work.

BRIEF SUMMARY OF THE INVENTION

In one embodiment of the invention a system is provided that has a dispenser enabled to contain and dispense a liquid or semi-liquid material and located on a wall of a facility having a door, a user-operable triggering mechanism causing dispensing of a volume from the dispenser upon operation of the triggering mechanism, and a door latch mechanism incorporated at an opening edge of the door of the facility and coupled to the dispenser in a manner that operating the triggering mechanism to dispense the volume also unlatches the door latch mechanism, allowing the door to open.

In one embodiment the dispenser is mounted to the door adjacent the door latch mechanism, and the dispenser and the door latch mechanism are mechanically coupled. In one embodiment the dispenser is mounted to an inside wall away from the door latch mechanism, and both the dispenser and the door latch mechanism further comprise wireless communication circuitry and electro-mechanical elements enabling signaling and operating the door latch mechanism remotely when the triggering mechanism is operated. Also in one embodiment the dispenser has a front face and a rear mounting face, and the triggering mechanism comprises an operating point beneath the dispenser and near the rear mounting face, such that a user must place a hand palm up beneath the dispenser, placing the palm directly below a dispensing outlet, to reach an activation point of the triggering mechanism with a finger of the hand, and operating the trigger mechanism causes the dispenser to dispense the volume into the palm and to also operate the door latch mechanism.

In one embodiment a time delay is provided between a dispensing action and operation of the door latch mechanism. In one embodiment the trigger mechanism comprises a forward and backward translatable lever that a user translates to implement dispensing the volume and operating the door latch mechanism. In one embodiment the trigger mechanism is pivoted, and an upward lifting of the activation point causes dispensing and unlatching of the door latch mechanism. And in one embodiment the dispenser further comprises electromechanical elements and circuitry, and the activation point comprises a button that closes a circuit to activate dispensing and operation of the door latch mechanism.

In an alternative aspect of the invention a method is provided comprising mounting a sanitizing lotion dispenser to an inside vertical surface of an enclosed toilet facility, and coupling the dispenser to a door latch mechanism latching a door to the enclosed facility closed in a manner that triggering the dispenser to dispense a volume also unlatches the door latch mechanism allowing a user to leave the facility.

In one embodiment of the method the dispenser is mounted to the door adjacent the door latch mechanism, and the dispenser and the door latch mechanism are mechanically coupled. Also in one embodiment the dispenser is mounted to an inside wall away from the door latch mechanism, and both the dispenser and the door latch mechanism further comprise wireless communication circuitry and electro-mechanical elements enabling signaling and operating the door latch mechanism remotely when the triggering mechanism is operated. Also in one embodiment the dispenser has a front face and a rear mounting face, and the triggering mechanism comprises an operating point beneath the dispenser and near the rear mounting face, such that a user must place a hand palm up beneath the dispenser, placing the palm directly below a dispensing outlet, to reach an activation point of the triggering mechanism with a finger of the hand, and operating the trigger mechanism causes the dispenser to dispense the volume into the palm and to also operate the door latch mechanism.

In one embodiment a time delay is provided between a dispensing action and operation of the door latch mechanism. Also in one embodiment the trigger mechanism comprises a forward and backward translatable lever that a user translates to implement dispensing the volume and operating the door latch mechanism. Also in one embodiment the trigger mechanism is pivoted, and an upward lifting of the activation point causes dispensing and unlatching of the door latch mechanism. And in one embodiment the dispenser further comprises electromechanical elements and circuitry, and the activation point comprises a button that closes a circuit to activate dispensing and operation of the door latch mechanism.

DETAILED DESCRIPTION OF THE INVENTION

The present invention in different embodiments described in enabling detail below in this specification, with reference to figures and element numbers provided with the specification, provides a solution to the ongoing problem of persons engaged in particularly food or produce-handling occupations failing to wash or otherwise sanitize their hands after using an enclosed toilet facility.

It is well-known that for health and sanitation purposes, one useful method is to dispense a sanitizer into the hands of the individual at the time of exiting the toilet area. Many enclosed toilet facilities, including portable facilities, are provided with a hand-sanitizer dispenser, with usually posted written instructions nearby stating the need or requirement that the sanitizer be properly used before returning to work. Use, however, is typically up to the choice and discretion of the person using the facility.

It is an important object of the present invention to associate a sanitizer dispenser with the toilet facility in a way that will significantly increase probability that the dispenser will be used, and the person's hands sanitized, before that person leaves the enclosed toilet facility.

Figure 1:
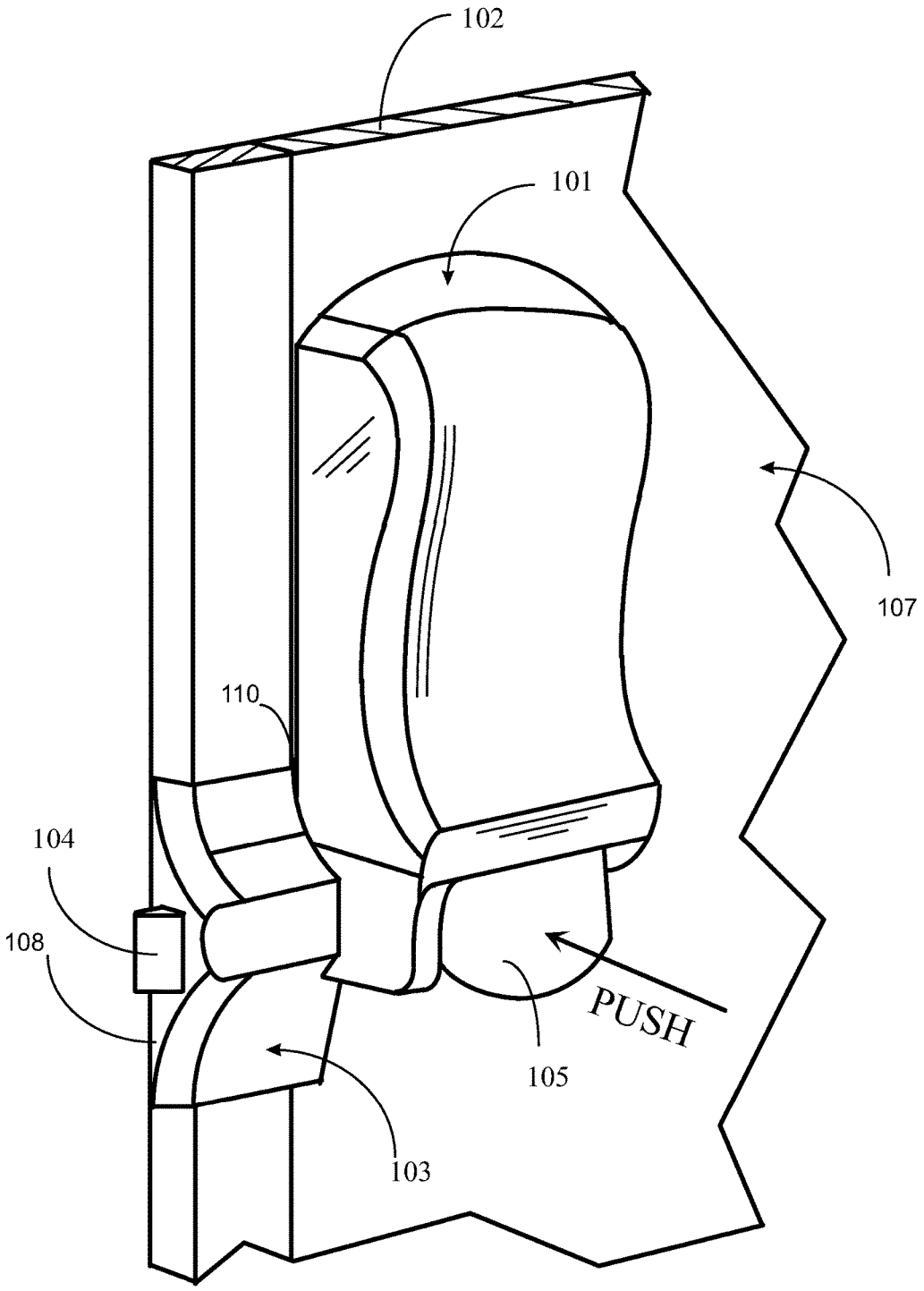
FIG. 1 is an isometric view of a hand-sanitizer dispenser integrated with a latch mechanism in an embodiment of the present invention.

FIG. 1 is a perspective elevation view of a hand sanitizer dispenser 101 mounted on the inside planar surface 107 of a door 102 of an enclosed toilet facility. A latch mechanism 103 is also positioned on planar surface 107 between the dispenser 101 and an edge 111 of the door. Dispenser 101 is positioned adjacent to the latch mechanism 103 along edge 110 opposite the latch side 108 of latch mechanism 103. Lever 105 is mechanically coupled to a latch mechanism 103 having a spring-loaded latch extension 104 extending away from the latch side 108. Lever 105 of dispenser 101 is substantially aligned with latch extension 104. Sanitizer lotion is dispensed from dispenser 101 by pushing lever 105, and may be caught in the palm of a person pushing lever 105 by placing the other hand under the dispenser. In this instance lever 105 operates a valve and manual pump mechanism that captures and dispenses a small volume of sanitizer material, and the lever is also mechanically coupled to an operating element of latch mechanism 103 to withdraw latch extension 104 against a spring such that the door may be pushed open.

The latch extension may also be withdrawn to open the door by an operating knob or lever not seen in this view, on the outside of the door, which may be disabled when the enclosed facility is occupied. When a person operates the latch from inside and leaves through the door, the door may swing shut and latch, and may be opened by the next person desiring to use the facility.

The person skilled in mechanical arts will understand that there are many ways the mechanical coupling of dispenser 101 and latch mechanism 103 may be accomplished. It is the fact of coupling that is believed by the inventor to be new and not obvious, and the inventor believes the invention as depicted in FIG. 1 will significantly increase the probability that a person using the facility will use the sanitizer.

Figure 2:
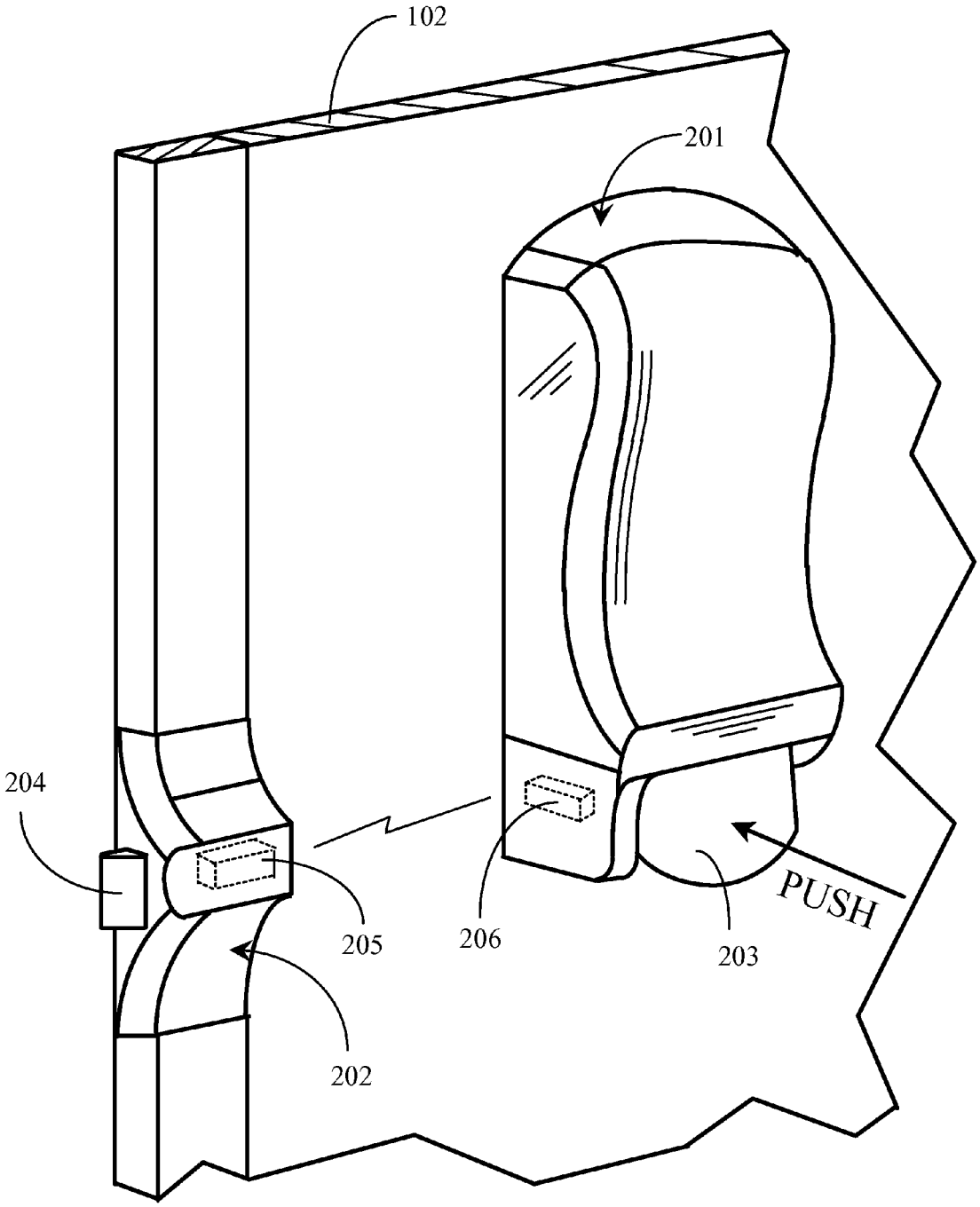
FIG. 2 is an isometric view of a hand-sanitizer dispenser integrated with a latch mechanism in another embodiment of the present invention.

FIG. 2 illustrates an alternative embodiment of the invention in which the dispenser need not be mechanically coupled to the latch mechanism. FIG. 2 illustrates a dispenser 201 mounted at a position away from the latch edge of the door and from latch mechanism 202. Dispenser 201 incorporates an electronic unit 206 enabled to send a wireless signal to an electronic unit 205 in latch mechanism 202. Pushing lever 203 dispenses sanitizing lotion which a user may catch in the hand, and also triggers unit 206 to signal unit 205 by such as Bluetooth™ or other wireless protocol. Upon receiving the signal from unit 206, unit 205 operates a solenoid (in one embodiment) to retract latch extension 204 to allow the door to open. IN one embodiment unit 205 is enabled with a timer that releases the solenoid after a short period, like 5 seconds, so the latch extension may re-extend (spring-loaded), so the door may again latch when closed. Dispenser 201 is shown still rather close to the latch mechanism in FIG. 2, but may in fact be mounted almost anywhere in the enclosed facility, even on another wall.

Figure 3:
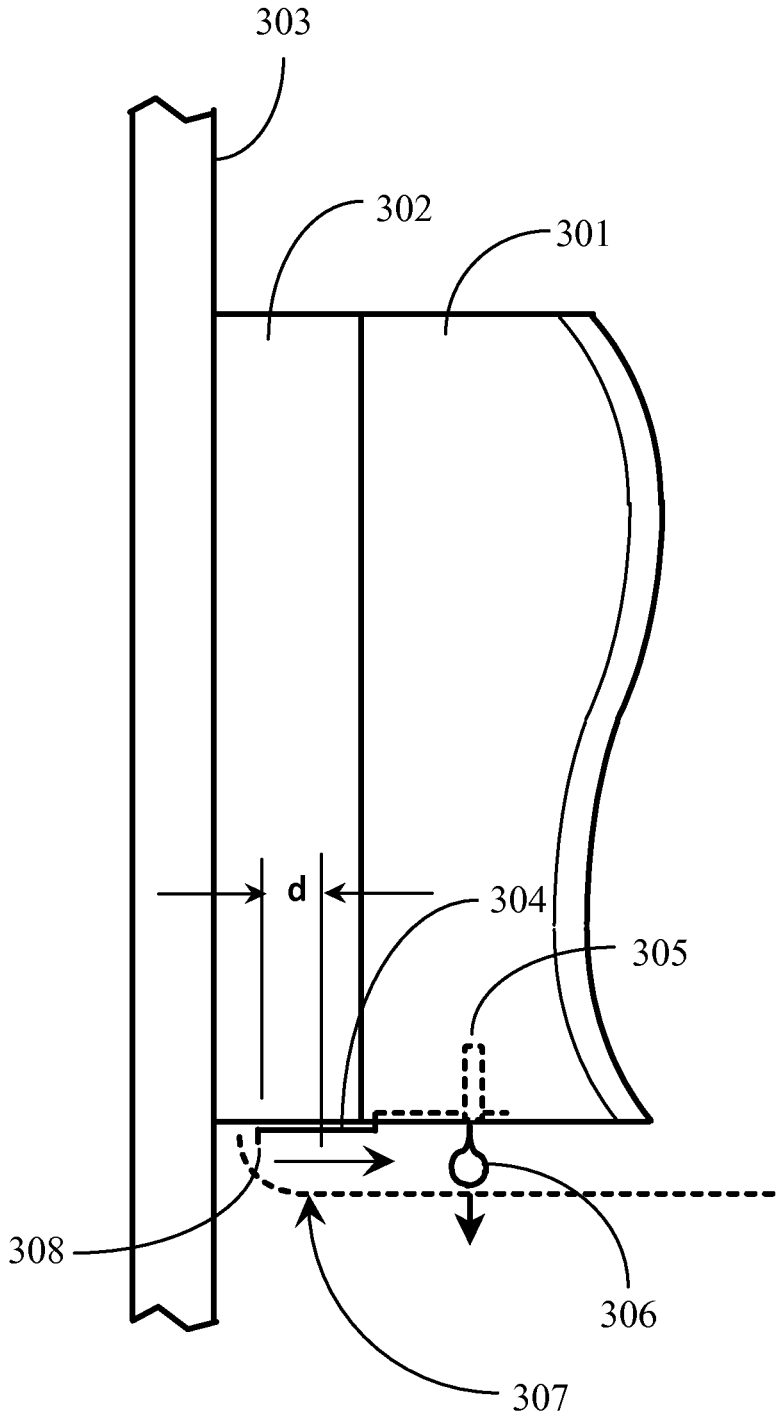
FIG. 3 is a side elevation view of a dispenser illustrating an operating trigger mechanism in an embodiment of the invention.

In yet another embodiment a special dispenser lever is provided for a dispenser that more positively ensures that a person will actually use the sanitizer lotion on the hands. FIG. 3 is a side elevation view of a dispenser 301 mounted to a spacer plate 302 which is mounted to door 303. A horizontally-translatable operating lever 304 is provided to operate a dispenser element 305 to dispense an amount 306 of sanitizer lotion downward. The operating lever has a lip or ring 308 located near the inner wall of door 303 with enough room behind the lip or ring for a user to hook the lip or ring with the middle finger of the left or right hand with the palm facing upward, as indicated by dotted line 307, and to then to translate the operating lever 304 forward, which movement causes element 305 to dispense the amount 306 of sanitizer lotion onto to the palm of the user's hand.

This implementation provides for one-hand operation ensuring that lotion is dispensed into the user's palm if the lever is activated, and the implementation is thus an improvement over dispensers that provide for placing one hand below the dispenser and initiating the dispensing action with the opposite hand. This embodiment is also useful manually engaged with a latch mechanism, as in the embodiment illustrated in FIG. 1, and in also with wireless communication causing operation of a door latch, as illustrated in FIG. 2. IN these combinations the one-hand operation to both dispense the lotion and unlatch the door provides an even higher probability that the user will sanitize the hands. One the lotion is dispensed onto the palm of one hand it is a natural motion to rub the hands together.

Figure 4:
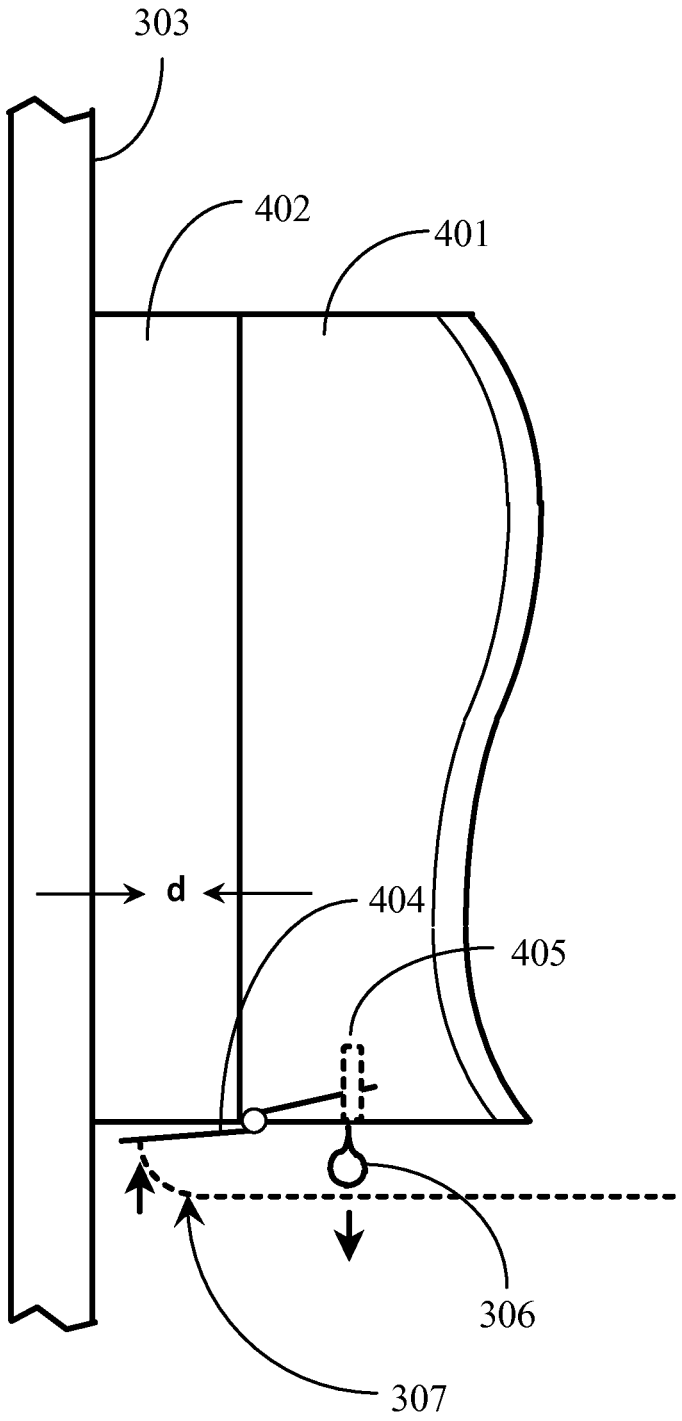
FIG. 4 is a side elevation view of a dispenser illustrating an operating trigger mechanism in another embodiment of the invention.

FIG. 4 illustrates yet another variation in which the operating lever is pivoted, and a user contacts the back portion of the pivoted lever with the middle or even the index or the ring finger, still with the palm facing upward as indicated by line 307. Upward pressure on the pivoted lever causes element 405 to dispense lotion into the palm of the user's hand. An advantage with this implementation and motion is that the user's hand does not move forward at all, and the palm is left directly below the dispensing point.

In another altenative implementation the dispenser may be electrically-powered, perhaps battery-powered, and there may be an operating button at the point shown for the user to lift the operating lever in FIG. 4. The button activates circuitry that causes the dispensation, and also operates the latch. In this implementation there may be a short time delay between dispensing and opening the latch.

In yet another alternative embodiment a downward-facing optical sensor may be incorporated at about the point shown for operating the lever or button in FIGS. 3 and 4. such that a user placing one hand below the dispenser with the palm facing upward, and a finger being sensed by the optical sensor, may trigger the dispensing and unlatching operation, again possibly with time delays as desired.

It is to be understood that the invention in different embodiments may be applicable to many situations other than those described in different embodiments above. It is also to be understood that the material that is dispensed is not a limitation in the invention. The material may be a sanitization material, a disinfectant, or any of a number of commercially available such materials, or even certain chemicals without limiting the invention, which is characterized by the electromechanical elements and their interaction. The invention in different embodiments is applicable to circumstances wherever there is a perceived need to enhance the probability that a person using a facility will use the dispenser before leaving the facility. The invention in various embodiments is thus applicable to situations in hospitals, clinics, produce stores, airline terminals, growing and harvesting operations, and even in homes and apartments, to name a few.

In the embodiments described above and other embodiments anticipated by the descriptions there may be instructions posted on the inside of the door or other places in the enclosed facility, and in alternative languages as desired, to instruct a person using the facility how to operate the dispenser and thus unlatch the door. Other instructions may be provided as well as to what alternative actions may be taken if, for some reason, the mechanisms fail to unlatch the door. In one such implementation a spring-loaded mechanism may be provided at the latch location such that, in the instance of an unlatch failure, the user may open the door with a strong push outward on the door.

The mechanically and electrically skilled person will understand that there are a rich variety of ways the dispensing and unlatching actions may be accomplished with a variety of mechanical and or electrical mechanisms, or both, and that there are a rich variety of dispenser apparatus that may be utilized in embodiments of the invention. The breadth of the invention is limited only by the metes and bounds of the claims below.

The invention claimed is:

1. A system, comprising:

a portable toilet facility having a door for entrance and exit, the door having a first surface facing outside the toilet facility and a second surface facing inside the toilet facility;

a door latch mechanism mounted at a vertical edge of the door on the second surface of the door, the door latch mechanism having a latch extension, that when extended, latches the door closed, and an operating element enabled to withdraw the latch extension, such that the door will open;

a dispenser enabled to contain and dispense a disinfectant material, the dispenser having a back surface mounting to the second surface of the door, and a front surface facing away from the second surface of the door;

a dispensing element below the dispenser, enabled to dispense the disinfectant material downward from the dispenser at a specific dispensing point beneath the dispenser; and a trigger mechanism having an operating point beneath the dispenser, the trigger mechanism coupled to both the dispensing element and the door latch mechanism, such that operating the trigger mechanism causes the dispenser to dispense a quantity of the disinfectant material downward at the dispensing point, and simultaneously causes the operating element to withdraw the latch extension, enabling the door to open;

wherein the operating point of the trigger mechanism is located near the back of the dispenser at the second surface of the door, and the dispensing point of the dispensing element is located at a distance from the location of the operating point of the trigger mechanism toward the front of the dispenser, away from the second surface of the door, such that to operate the trigger mechanism the user positions a hand, palm up, beneath the dispensing point, and reaches and operates the trigger mechanism with a finger of the hand, causing the dispenser to dispense the quantity of liquid or semi-liquid material into the palm of the user's hand, and causing the operating element to withdraw the latch extension.

2. The system of claim 1 wherein the trigger mechanism is coupled mechanically to the door latch mechanism, and operating the trigger mechanism causes the latch extension to withdraw.

3. The system of claim 1 wherein the dispenser is mounted at a distance away from the door latch mechanism, and both the dispenser and the door latch mechanism further comprise wireless communication circuitry and electro-mechanical elements enabling signaling and operating the door latch mechanism remotely when the trigger mechanism is operated.

4. The system of claim 3 wherein a time delay is provided between a dispensing action and operation of the door latch mechanism.

5. The system of claim 1 wherein the trigger mechanism comprises a forward and backward translatable lever that a user translates to implement dispensing the volume and operating the door latch mechanism.

6. The system of claim 1 wherein the trigger mechanism is pivoted, and an upward lifting of the activation point causes dispensing and unlatching of the door latch mechanism.

7. The system of claim 3 wherein the trigger mechanism is a button that closes a circuit to activate dispensing and operation of the door latch mechanism.

8. A method, ensuring that a user of a toilet facility having a door for entrance and exit, the door having a first surface facing outside the toilet facility and a second surface facing inside the toilet facility, uses a disinfectant solution on the user's hands before leaving the toilet facility, comprising:

Providing a door with a door latch mechanism, wherein a latch extension opens and closes the door latch mechanism, Mounting a dispenser enabled to contain and dispense the disinfectant solution, by a back surface to the second surface of the door, leaving a front surface of the dispenser facing away from the second surface of the door, the dispenser having a dispensing element below the dispenser, enabled to dispense the liquid or semi-liquid material downward from the dispenser at a dispensing point beneath the dispenser; and Providing a trigger mechanism having an operating point beneath the dispenser, the trigger mechanism coupled to both the dispensing element and the door latch mechanism, such that operating the trigger mechanism causes the dispenser to dispense a quantity of the disinfectant solution downward at the dispensing point, and simultaneously causes the operating element to withdraw the latch extension, enabling the door to open, the operating point of the trigger mechanism located near the back of the dispenser at the second surface of the door, and the dispensing point of the dispensing element located at a distance closer to the front surface of the dispenser than the operating point, away from the second surface of the door, such that to operate the trigger mechanism the user positions a hand, palm up, beneath the dispensing point, and reaches and operates the trigger mechanism with a finger of the hand, causing the dispenser to dispense the quantity of liquid or semi-liquid material into the palm of the user, and simultaneously causing the operating element to withdraw the latch extension.

9. The method of claim 8, comprising mounting the dispenser at a distance away from the door latch mechanism, and providing wireless communication circuitry and electro-mechanical elements in both the trigger mechanism and the door latch mechanism, enabling signaling and operating the door latch mechanism remotely when the trigger mechanism is operated.

10. The method of claim 9 wherein a time delay is provided between a dispensing action and operation of the door latch mechanism.

11. The method of claim 8 comprising translating by the user a forward and backward translatable lever to implement dispensing the disinfectant and operating the door latch mechanism.

12. The method of claim 8 comprising lifting a pivoted lever of the trigger mechanism, causing dispensing and unlatching of the door latch mechanism.

13. The method of claim 8 comprising depressing by a user a button closing a circuit to activate dispensing and operation of the door latch mechanism.

* * * * *